US009034076B2

(12) United States Patent
Sieger et al.

(10) Patent No.: US 9,034,076 B2
(45) Date of Patent: May 19, 2015

(54) PROCESS AND APPARATUS FOR WINNING OIL FROM A VAPOR GAS MIXTURE

(71) Applicants: Hermann Sieger, Darmstadt (DE); Christian Binder, Frankfurt am Main (DE); Hans-Joachim Werz, Frankfurt am Main (DE); Nikola Anastasijevic, Altenstadt (DE); Andreas Orth, Friedrichsdorf (DE); Aleksandr Kaidalov, Narva-Joesuu (EE); Kirill Kaidalov, Narva (EE)

(72) Inventors: Hermann Sieger, Darmstadt (DE); Christian Binder, Frankfurt am Main (DE); Hans-Joachim Werz, Frankfurt am Main (DE); Nikola Anastasijevic, Altenstadt (DE); Andreas Orth, Friedrichsdorf (DE); Aleksandr Kaidalov, Narva-Joesuu (EE); Kirill Kaidalov, Narva (EE)

(73) Assignee: ENEFIT OUTOTEC TECHNOLOGY OÜ, Tallinn (EE)

( * ) Notice: Subject to any disclaimer, the term of this patent is extended or adjusted under 35 U.S.C. 154(b) by 0 days.

(21) Appl. No.: 14/352,061

(22) PCT Filed: Oct. 10, 2012

(86) PCT No.: PCT/EP2012/069991

§ 371 (c)(1),
(2) Date: Apr. 16, 2014

(87) PCT Pub. No.: WO2013/057010

PCT Pub. Date: Apr. 25, 2013

(65) Prior Publication Data

US 2014/0251132 A1 Sep. 11, 2014

(30) Foreign Application Priority Data

Oct. 21, 2011 (EP) ..... 11186145

(51) Int. Cl.
*B03C 3/011* (2006.01)
*B03C 3/00* (2006.01)

(52) U.S. Cl.
CPC .. *B03C 3/011* (2013.01); *B03C 3/00* (2013.01)

(58) Field of Classification Search
CPC ..... B01D 3/00; B01D 3/14; B01D 5/00; B01D 5/0027; B01D 5/0033; B01D 5/0036; B03C 3/00; B03C 3/017; B03C 3/019; B03C 3/34; B03C 3/38; B03C 3/40; B03C 3/45; B03C 3/455; B03C 9/00; C10B 53/02; C10B 5/00; C10B 49/08; C10K 1/04; C10K 1/028; Y02E 50/14
USPC ..... 95/57, 63, 73, 79; 96/15, 74, 98; 201/19
See application file for complete search history.

(56) References Cited

U.S. PATENT DOCUMENTS 2,013,753 A * 9/1935 Hahn ..... 95/71
3,800,505 A * 4/1974 Tarves, Jr. ..... 95/66

(Continued)

FOREIGN PATENT DOCUMENTS

CA 2311738 A1 * 11/2001
CN 101948700 A 1/2011

(Continued)

OTHER PUBLICATIONS

Ullmann's Encyclopedia of Industrial Chemistry, Distillation, chapter 4 Rectification (Multi-stage Distillation), Weinheim, Dec. 2010, Wiley-VCH Verlag GmbH & Co. KG aA, DOI:10.1002/14356007.B03_04. Pub2., pp. 15-31.

*Primary Examiner* — Duane Smith
*Assistant Examiner* — Sonji Turner
(74) *Attorney, Agent, or Firm* — Leydig, Voit & Mayer, Ltd.

(57) ABSTRACT

A process for winning oil from a vapor gas mixture (VGM) containing a plurality of oil fractions obtained by the pyrolysis of a hydrocarbon containing material includes dedusting and cooling the VGM. The dedusted and cooled VGM are fractionated in at least two electrostatic precipitator stages at respective temperatures corresponding to respective boiling points of the oil fractions so as to separate the oil fractions.

15 Claims, 5 Drawing Sheets

(56) References Cited

U.S. PATENT DOCUMENTS

| | | | | |
|---|---|---|---|---|
| 3,899,308 | A * | 8/1975 | Petersson | 95/66 |
| 4,145,191 | A * | 3/1979 | Kunchal et al. | 95/65 |
| 4,365,976 | A * | 12/1982 | Frohnert et al. | 95/81 |
| 4,373,995 | A * | 2/1983 | Bowen et al. | 202/95 |
| 4,375,402 | A * | 3/1983 | Durai-Swamy | 208/411 |
| 4,696,679 | A * | 9/1987 | Albulescu et al. | 48/203 |
| 5,282,885 | A * | 2/1994 | Cameron | 95/66 |
| 5,300,270 | A * | 4/1994 | Krigmont et al. | 423/239.1 |
| 5,364,457 | A * | 11/1994 | Cameron | 96/27 |
| 6,036,484 | A * | 3/2000 | Carcer et al. | 432/105 |
| 6,294,003 | B1 * | 9/2001 | Ray | 96/49 |
| 7,998,315 | B2 * | 8/2011 | Bridgwater et al. | 201/2.5 |
| 8,043,391 | B2 * | 10/2011 | Dinjus et al. | 48/197 R |
| 8,202,332 | B2 * | 6/2012 | Agblevor | 48/197 R |
| 8,476,480 | B1 * | 7/2013 | Brown et al. | 585/240 |
| 2004/0220285 | A1 * | 11/2004 | Boerrigter et al. | 518/726 |
| 2005/0039599 | A1 * | 2/2005 | Johnson et al. | 95/271 |
| 2007/0125637 | A1 * | 6/2007 | Merrell et al. | 202/92 |
| 2008/0236043 | A1 * | 10/2008 | Dinjus et al. | 48/197 R |
| 2009/0165378 | A1 * | 7/2009 | Agblevor | 48/127.7 |
| 2009/0227766 | A1 * | 9/2009 | Bridgwater et al. | 530/202 |
| 2010/0212215 | A1 * | 8/2010 | Agblevor | 44/300 |
| 2010/0216898 | A1 * | 8/2010 | Tonseth | 518/703 |
| 2010/0263487 | A1 * | 10/2010 | Orth | 75/477 |
| 2012/0304540 | A1 * | 12/2012 | Hulteberg et al. | 48/128 |

FOREIGN PATENT DOCUMENTS

| | | | |
|---|---|---|---|
| DE | 10058995 | A1 | 6/2002 |
| JP | 2009195860 | A | 9/2009 |

* cited by examiner

PROCESS AND APPARATUS FOR WINNING OIL FROM A VAPOR GAS MIXTURE

CROSS-REFERENCE TO PRIOR APPLICATIONS

This application is a U.S. National Phase Application under 35 U.S.C. §371 of International Application No. PCT/EP2012/069991, filed on Oct. 10, 2012, and claims benefit to European Patent Application No. EP 1 1186 145.6, filed on Oct. 21, 2011. The International Application was published in English on Apr. 25, 2013 as WO 2013/057010 A1 under PCT Article 21(2).

FIELD

The present invention is directed to a process and an apparatus for winning oil from a vapor gas mixture obtained by the pyrolysis of a hydrocarbon containing material, in particular oil shale, wherein the vapor gas mixture generated in the pyrolysis containing several oil fractions is dedusted and the oil fractions are separated based on their condensation temperature.

BACKGROUND

In order to obtain oil from oil shale, the oil shale is directly heated by a hot heat carrier (ash) to a temperature of about 500° C. in a rotary kiln. Hereby, oil evaporates from the oil shale forming the so called vapor gas mixture (VGM). The vapor gas mixture (a gas containing also fine particles) is then quenched in a condensation unit for winning the oil. This oil contains particulate material (fines) which traditionally are separated from the oil in a scrubber. The dust particles collected by droplets produced in the scrubber can be found in the cooled oil at the scrubber bottom. The thus dedusted oil is further treated in a rectification column to separate various oil fractions contained in the pyrolysis oil based on their boiling point in a multiple distillation.

Rectification is a standard procedure and described, e.g., in Ullmann's Encyclopedia of Industrial Chemistry, Distillation, chapter 4 Rectification (Multi-stage Distillation), Weinheim 2010, Wiley-VCH Verlag GmbH & Co. KG aA, DOI: 10.1002/14356007.B03_04. pub2. There are, however, several problems in adequately controlling the fractionation separation in the rectification column. Rectification columns usually operate with a substantial amount of reflux reducing the productivity. Further, due to the packings provided in the rectification stages there is a substantial pressure loss over the column.

SUMMARY

In an embodiment, the present invention provides a process for winning oil from a vapor gas mixture (VGM) containing a plurality of oil fractions obtained by the pyrolysis of a hydrocarbon containing material. The VGM is dedusted and cooled. The dedusted and cooled VGM are fractionated in at least two electrostatic precipitator stages at respective temperatures corresponding to respective boiling points of the oil fractions so as to separate the oil fractions.

BRIEF DESCRIPTION OF THE DRAWINGS

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following.

DETAILED DESCRIPTION

Figure 1:
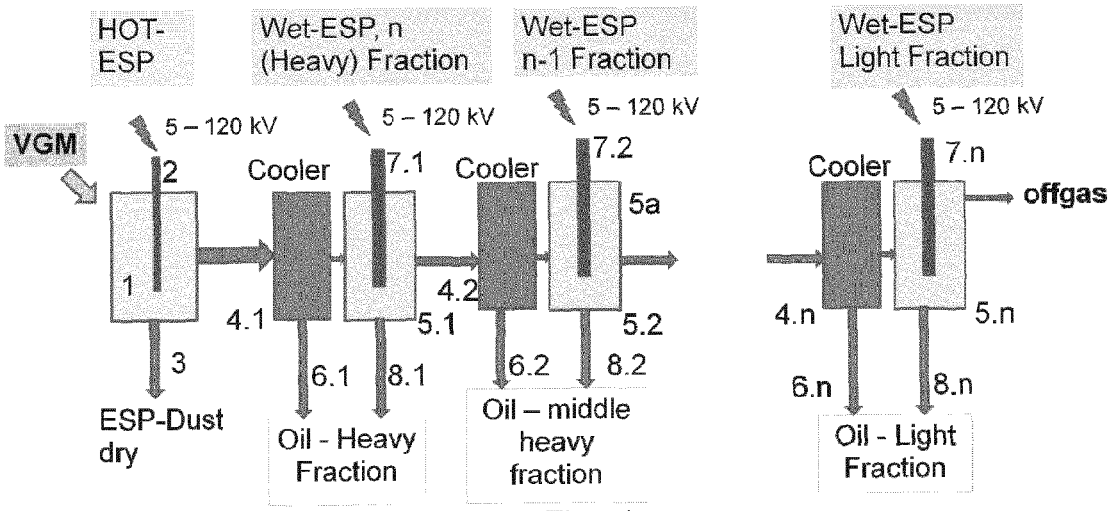
FIG. 1 is a schematic view of an apparatus according to a first embodiment of the present invention.

In an embodiment, the present invention provides for a more efficient production of oil from oil shale or the like. In particular, the separation of the desired oil fractions contained in the vapor gas mixture obtained by pyrolysis shall be optimized.

According to an embodiment of the present invention, there is provided a process, wherein the dedusted VGM is cooled and subsequently fractionated in at least two electrostatic precipitator stages at a temperature adapted to the boiling point of the respective oil fraction to be separated. An embodiment of the invention, therefore, replaces the standard rectification column by several electrostatic precipitators and coolers. The cooling and aerosol precipitation by the electrostatic precipitators ensures the capturing of almost all oil condensate droplets of the desired oil fraction without additional energetic expense. In comparison to the standard rectification column, the electrostatic precipitators do not require any or at least less reflux so that the apparatus can be built smaller and makes the process more efficient. Further, the apparatus does not need to contain any packings and the pressure drop is much smaller.

An electrostatic precipitator (ESP) is a particulate collection device that removes particles from the VGM using the force of induced electrostatic charge.

It should be noted that instead of oil shale other hydrocarbon containing materials, such as oil sand, biomass, plastics, oil wastes, waste oils, animal fat containing materials, or vegetable oil containing materials may be used for the process of the present invention as long as a vapor gas mixture containing oil fractions can be produced by the pyrolysis of said material. Preferably, the hydrocarbon material contains 8 to 80% by weight of hydrocarbons.

Depending on the number of desired oil fractions, the amount of coolers and electrostatic precipitators can be adjusted for defining the oil fractions according to their boiling points.

According to a preferred embodiment of the present invention the vapor gas mixture comprises 40 to 90% by weight of $C_{5+}$ hydrocarbons, 4.5 to 40% by weight of $C_{4-}$ hydrocarbons, 0.01 to 30% by weight of non condensable fractions (i.e. gases like $H_2$, $N_2$, $H_2S$, $SO_2$, NO, etc.) and 5 to 30% by weight of water. Preferably, the composition of the vapor gas mixture is as follows: 55 to 85% by weight of $C_{5+}$ hydrocarbons, 7 to 25% by weight of $C_{4-}$ hydrocarbons, 0.1 to 15% by weight of non condensable fractions and 7 to 20% by weight of water, more preferably the composition of the vapor gas mixture is as follows: 60 to 80% by weight of $C_{5+}$ hydrocarbons, 13 to 22% by weight of $C_{4-}$ hydrocarbons, 0.3 to 10% by weight of non condensable fractions and 7 to 15% by weight of water. In the dedusting stage prior to the electrostatic precipitators the dust contained in the original pyrolysis oil is substantially removed so that the VGM entering the fractionation stage preferably has a dust content of <30 ppm.

Preferably, the electrostatic precipitator is operated at a voltage of 5 to 120 kV.

In a preferred embodiment of the invention, the voltage imposed by the electrode of the electrostatic precipitator is individually controlled for each fractionation stage so that an optimum electrode voltage is provided depending on the gas composition, which may change from stage to stage.

The cooling of the VGM may be performed in a separate cooler or within the electrostatic precipitator. Preferably, an indirect cooling with water or air is provided. For direct cooling, oil may be injected into the VGM.

The VGM may be introduced into a stage of the electrostatic precipitator at the top or at the bottom so that a cocurrent or a countercurrent operation is possible.

In a preferred embodiment of the invention a part of the oil withdrawn from the electrostatic precipitator is recycled to the electrostatic precipitator for directly cooling the VGM within the precipitator.

In order to ensure a very low dust content of the VGM entering the fractionation stage, the dedusting of the VGM originating from the pyrolysis is performed in an electrostatic precipitator operated at a temperature of 380 to 480° C. This electrostatic precipitator is operated in dry state at a temperature above the condensation temperature of the oil so that the dust is separated without any condensation of oil. This substantially reduces the contamination of the product (pyrolysis oil) so that the subsequent fractionation results in products of higher quality. The electrostatic precipitator is a highly efficient filtration device that minimally impedes the flow of gases through the precipitator and can easily remove the fine dust particles from the VGM. For implementing the present invention, the electrostatic precipitator may be a tube, plate or a chamber precipitator, wherein a tube precipitator is preferred. Generally, the present invention, however, can also be used with standard dedusting techniques such as a scrubber or a hot filtration device like ceramic or metallic or other heat resistant candles.

An embodiment of the invention is also directed to an apparatus for winning oil from a vapor gas mixture obtained by the pyrolysis of an oil containing material, such as oil shale, which is suited for performing a process as described above and comprises a dedusting stage for removing dust from the VGM and a separation stage for separating oil fractions of the VGM based on their boiling points. According to the invention, the apparatus comprises at least two electrostatic precipitator stages each associated with a cooling stage and operated at a temperature adapted to the boiling point of the respective oil fraction to be separated.

In one embodiment, each electrostatic precipitator is associated to a separate cooler.

Preferably, the distance between the electrode and the precipitator walls is 100 to 1000 mm, more preferably 200 to 600 mm.

In another preferred embodiment, the electrostatic precipitator is formed as a condensation column comprising an electrode for each fractionation step. Thereby, a compact structure is possible while the separate electrodes provide for an efficient definition of the fractionation at the various stages.

In the condensation column, the electrostatic precipitator comprises a number of trays corresponding to the number of oil fractions to be separated, so that these oil fractions can be reliably captured and withdrawn.

It is preferred that the electrostatic precipitator has cooling walls (with/without increased surface), which assist or replace the separate coolers. Thereby, a more compact structure is possible.

In the first embodiment of the present invention as shown in FIG. 1 an apparatus for winning oil comprises a first electrostatic precipitator (ESP) 1 for dedusting a vapor gas mixture (VGM) obtained by the pyrolysis of oil shale or any other suitable material. The electrostatic precipitator 1 is operated at a temperature of 380 to 480° C., and a voltage of 5 to 120 kV is imposed by an electrode 2. Thereby, the dust is separated from the oil vapor and settles on the tube walls from where it can be removed by rattling or other suitable mechanical measures. The dust is withdrawn via line 3. The electrostatic precipitator 1 may have one or more stages and combine dry and wet electrostatic precipitators.

Subsequent to the dedusting stage in electrostatic precipitator 1 several fractionation stages are provided for separating the pyrolysis oil obtained from the dedusting stage into various oil fractions. Each such fractionation stage comprises a cooler 4 and a subsequent electrostatic precipitator 5. The electrostatic precipitators preferably are operated as wet electrostatic precipitators. The wet precipitators are operated at a temperature below the condensation temperature of hydrocarbons contained in the gas. As the VGM is cooled, small condensed droplets are formed which are dispersed as aerosols in the gas stream. The main part of the condensed droplets is collected at the cooler surface, the droplets remaining in the gas stream, being small enough, pass through the cooler. After charging them via the electrode, they are separated at the counter-electrode. Thereby, the wet electrostatic precipitators precipitate all wet/condensed components from the gas. The electrostatic precipitators 5 are tubular filters wherein a suitable distance between the electrode 7 inducing the electrical field and the precipitator walls 5*a* is 100 to 1000 mm, preferably 200 to 600 mm. This obviously depends from the dimensions of the electrostatic precipitator.

In the coolers 4 the VGM is cooled to a temperature corresponding to the boiling/condensation point of the desired oil fraction. For example, in the first fractionation stage (cooler 4.1 and electrostatic precipitator 5.1) the VGM is cooled to about 270° C. to condense a heavy oil fraction. The electrostatic precipitator 5.1 operates at a constant temperature±10° C. of the cooler downstream temperature. The oil fraction that condenses in the cooler 4.1 is accumulated and withdrawn via line 6.1. In the electrostatic precipitator 5.1 a voltage of 5 to 120 kV is imposed by an electrode 7.1. The electric field ionizes droplets thereby enhancing the deposition on the walls so that the condensed heavy oil fraction may be withdrawn via line 8.

The remaining VGM then is conducted to the next fractionation stage which basically corresponds to the first fractionation stage but operates at a lower temperature corresponding to a boiling/condensation point of the next heavy oil fraction. The number of the fractionation stages 1 to n corresponds to the number of the desired oil fractions to be separated. The temperature differences between the fractionation stages as determined by the respective coolers 4 and electrostatic precipitators 5 is e.g. 50° C. It, however, is not necessary that the temperature intervals between the fractionation stages are regular. It is just as well possible that irregular intervals are chosen depending on the desired oil fractions.

Figure 2:
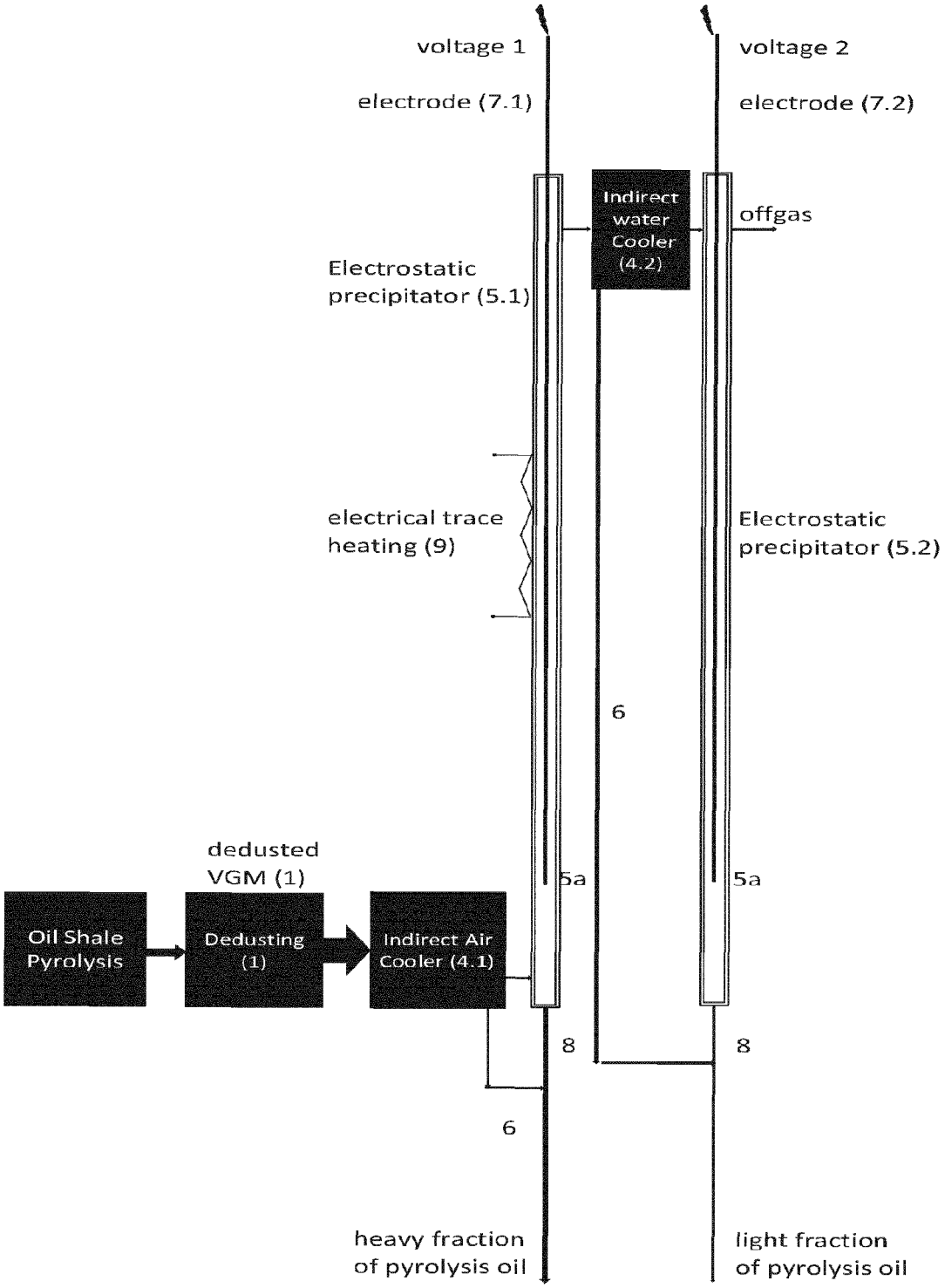
FIG. 2 shows a modification of the apparatus according to the first embodiment.

In the modification of the first embodiment according to FIG. 2, the fractionation stages are shown in more detail. The temperature of the electrostatic precipitators 5.1 and 5.2 is maintained by respective electrical trace heaters 9 or any other suitable heating device.

Downstream of the dedusting stage, the dedusted VGM is cooled in a cooler 4.1 by indirect air cooling before entering the first electrostatic precipitator 5.1. Contrary to that, the cooler 4.2 upstream of the second electrostatic precipitator 5.2 is provided as an indirect water cooler. The cooling medium may be chosen as required.

While FIG. 2 shows two electrostatic precipitation stages 5.1 and 5.2 only for separating a heavy fraction and a light fraction of the pyrolysis oil, it can be easily understood, that additional cooling stages 4 and electrostatic precipitators 5 may be provided to increase the selectivity of the fractionation and to obtain more oil fractions.

Figure 4:
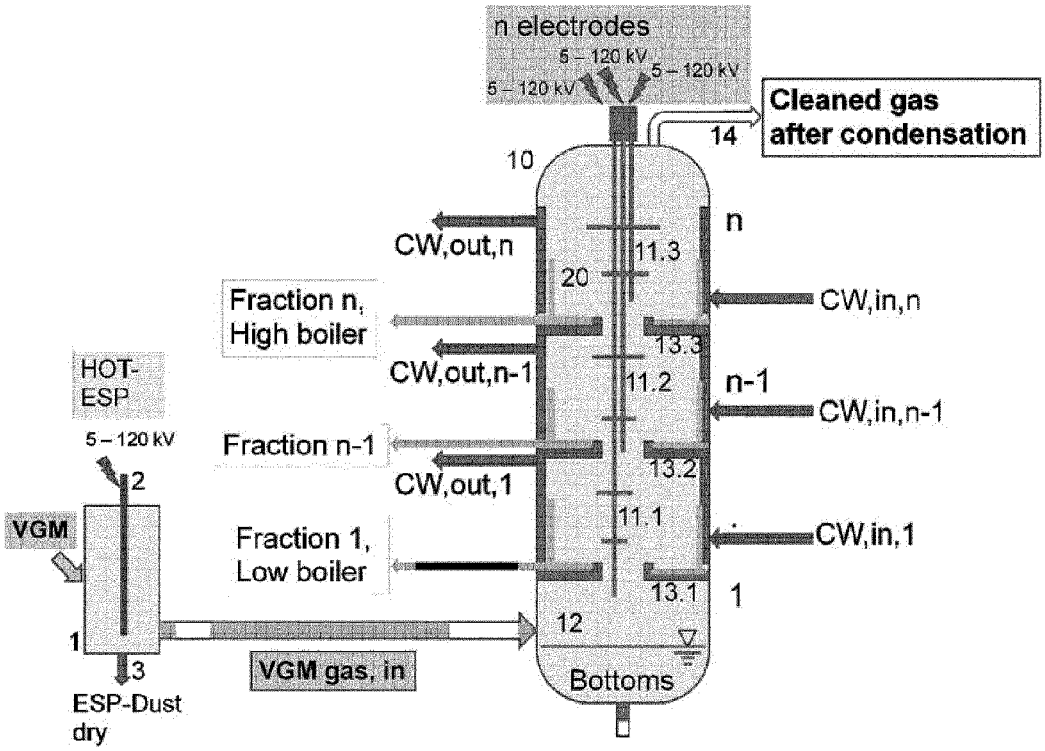
FIG. 4 is a schematic view of an apparatus according to a second embodiment of the present invention.

In the embodiment according to FIG. 4, the fractionation of the dedusted VGM is performed in an electrostatic precipitator 10 formed as a condensing column comprising electrodes 11 for each fractionation step.

The VGM gas leaving the dedusting stage 1 is introduced into the lower part 12 of the electrostatic precipitator 10. From there it enters the first stage of the electrostatic precipitator where it is cooled to a predetermined temperature, for example by injecting recycled oil or by cooling walls or elements, so that a heavy oil fraction is condensed and collected on a tray 13.1 and withdrawn from the column. The remaining VGM is introduced into the next stage at a predetermined lower temperature to condense the next desired oil fraction, which is collected on tray 13.2 and withdrawn from the column. The then remaining VGM is introduced into the next stage which is operated at a predetermined temperature for condensing a high boiling oil fraction (light oil fraction) which is collected on tray 13.3 and withdrawn from the column. The offgas is withdrawn via line 14.

For each stage of the electrostatic precipitator 10 an electrode 11 is provided with imposes a suitable voltage adapted to the gas composition in the respective stage, usually between 5 and 120 kV.

Figure 5:
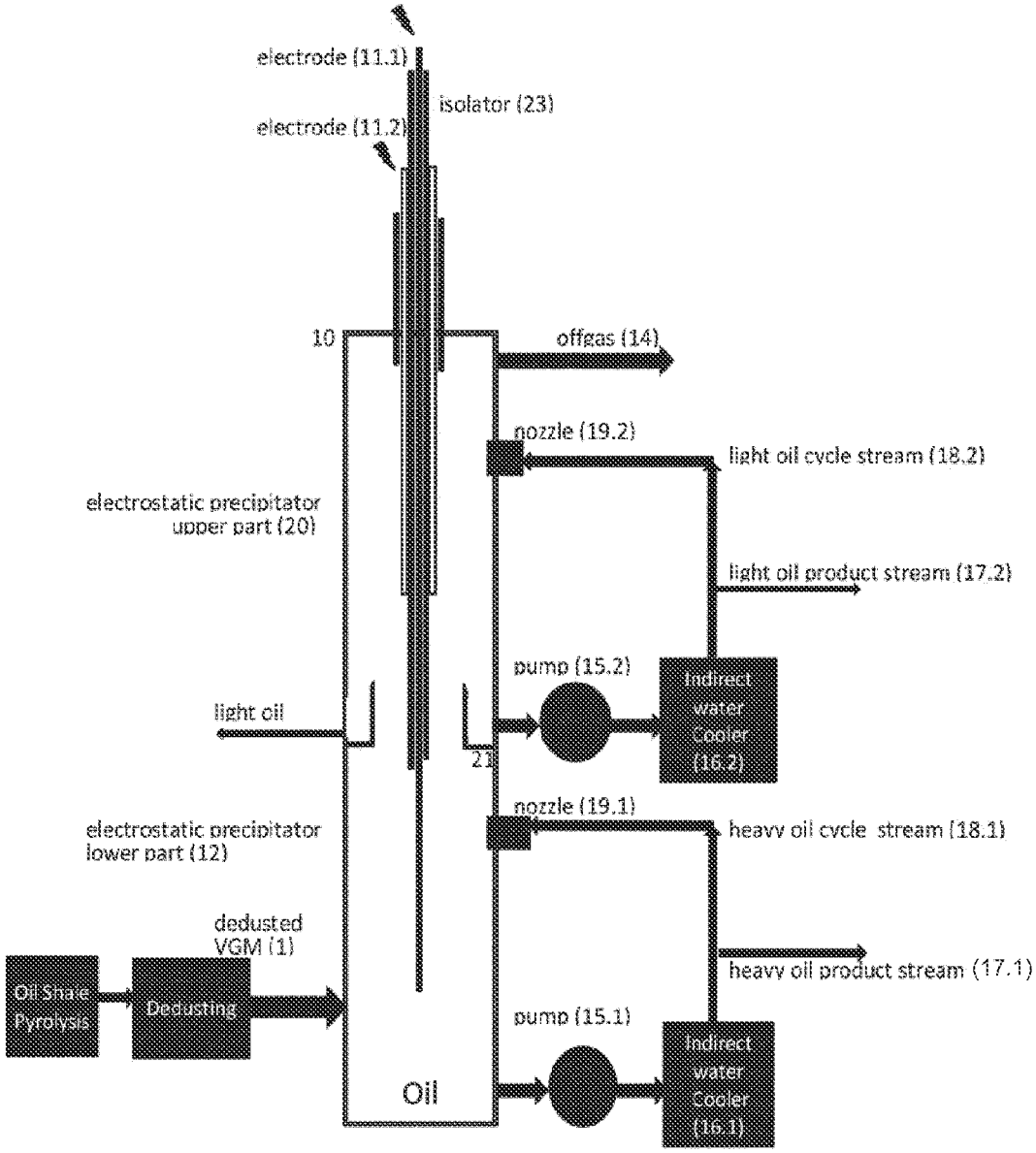
FIG. 5 shows a modification of the apparatus according to the second embodiment.

FIG. 5 shows a more detailed structure of the electrostatic precipitator 10. For simplification purposes, only two fractionation stages are shown for withdrawing a heavy oil stream and a light oil stream.

The dedusted VGM is introduced into the lower part 12 of electrostatic precipitator 10. Heavy oil collected at the bottom of the electrostatic precipitator 10 is withdrawn by means of a pump 15.1 and cooled in an indirect water cooler 16.1. The oil stream then is separated into a product stream withdrawn via line 17.1 and a recycle stream recycled to the column via recycle line 18.1 and introduced into the electrostatic precipitator through nozzle 19.1 to cool the VGM introduced into the electrostatic precipitator 10. Thereby, the heavy oil fraction condenses and is collected at the bottom of the column and withdrawn via pump 15.1. The remaining VGM enters the upper part 20 of the electrostatic precipitator 10 at approximately 270° C. In a structure similar to the lower part 12, the oil fraction condensing in the upper part 20 of the electrostatic precipitator is collected on a tray 21 and withdrawn via pump 15.2 and indirectly cooled in cooler 16.2 to room temperature. Again, the oil stream is divided in a product stream withdrawn through line 17.2 and a recycle stream to the electrostatic precipitator via nozzle 19.2 in order cool the VGM entering from the lower part 12. The offgas is withdrawn through line 14.

The electrodes 11 are centrally mounted to the ceiling 22 of the electrostatic precipitator 10 and extend into the respective part 12, 20 of the electrostatic precipitator. The electrode 11.1 and 11.2 are separated from each other by an isolator 23.

While in FIG. 5 only two parts 12, 20 of the electrostatic precipitator 10 are shown for obtaining a heavy oil fraction and a light oil fraction it can be easily understood that additional parts may be provided in order to increase the selectivity of the electrostatic precipitator 10 and to obtain additional oil fractions.

Embodiments of the invention will now be further explained by way of examples which are based on research plants according to FIGS. 2 and 5, respectively.

Example 1 (Based on FIG. 2)

TABLE 1

| Vapor gas mixture VGM<br>Composition of VGM before electrostatic precipitator 5 | |
|---|---|
| H2 | 6.2 g/h |
| Methane | 13 g/h |
| CO | 9.6 g/h |
| CO2 | 128 g/h |
| Ethylene + Ethane | 17 g/h |
| Propylene + Propane | 14 g/h |
| HC4 to HC6 | 23.6 g/h |
| water | 110 g/h |
| Pyrolysis oil, condensable at 23° C. | 310 g/h |

The vapor gas mixture (VGM) is produced by pyrolysis of oil shale type I and is then dedusted. The composition of the VGM is found in table 1. The dedusted VGM stream enters the indirect air cooler 4 at 430° C. and is cooled down to 280° C. Due to the cooling to 280° C. the heavier components of the VGM stream condense. A part of the condensed phase separates from the gas stream in the cooler but a significant fraction of the condensed phase leaves the cooler as a fine aerosol. The fine aerosol is then separated by the electrostatic precipitator 5. The temperature of the electrostatic precipitator is controlled by an electrical trace heater 9 to 280° C. The applied voltage to the electrodes 7 is controlled between 5 kV and 20 kV. A heavy fraction of pyrolysis oil of 37 g/h (12 wt.-% of total collected oil) was collected by air cooler 4.1 and electrostatic precipitator 5.1.

The remaining VGM is then cooled down to 23° C. and enters a tubular electro static precipitator 5.2 that is also operated at 23° C. The applied voltage to the electrodes is controlled between 5 kV and 20 kV. A light fraction of pyrolysis oil of 275 g/h (88 wt.-% of total collected oil) is collected.

Figure 3:
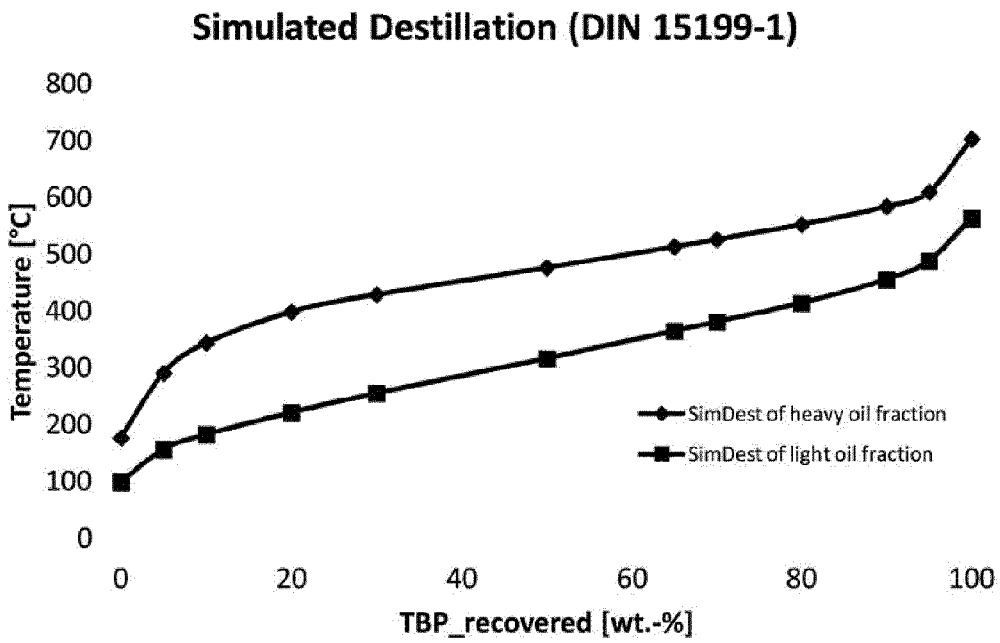
FIG. 3 shows the result of a simulated distillation based on the apparatus according to FIG. 2.

FIG. 3 displays the results of the simulated distillation of the heavy and the light oil fraction. The results demonstrate the high differences of the boiling point curves for the two obtained oil fractions.

Example 2 (Based on FIG. 5)

TABLE 2

| Vapor gas mixture VGM<br>Composition of dedusted VGM | |
|---|---|
| H2 | 14 g/h |
| Methane | 24 g/h |
| CO | 16 g/h |
| CO2 | 240 g/h |
| Ethylene + Ethane | 38 g/h |
| Propylene + Propane | 26 g/h |
| HC4 to HC6 | 51 g/h |
| water | 400 g/h |

TABLE 2-continued

| Vapor gas mixture VGM Composition of dedusted VGM | |
|---|---|
| Pyrolysis oil, condensable at 23° C. | 580 g/h |

The vapor gas mixture (VGM) is produced by pyrolysis of oil shale type II and is then dedusted. The composition of the VGM is found in the table 2. The dedusted VGM stream enters the lower part 12 of the condensation unit 10. The condensation unit is a tubular arranged electrostatic precipitator. A voltage of 12-17 kV is applied to the electrode 11.1. The VGM is cooled down to approximately 270° C. by the heavy oil recycle stream that is injected via nozzle 19.1. The injected heavy oil mist and the additionally condensed fraction of the VGM are separated from the gas stream by the electric field. A pump 15.1 is pumping the heavy oil to the nozzle 19.1. After the indirect water cooler 16.1 a certain fraction of heavy oil is removed as heavy oil product stream. The remaining fraction is recycled through the nozzle 19.1 to the electrostatic precipitator 10.

The remaining VGM enters the upper part 20 of the electrostatic precipitator 10 at approximately 270° C. A voltage of 15-25 kV is applied to the electrode 11.2. The remaining VGM is cooled down to approximately 23° C. by a light oil recycle stream that is injected by the nozzle 19.2 into the condensation unit. The injected light oil mist and the additionally condensed fraction of the remaining VGM are separated from the gas stream by the electric field. A pump 15.2 is pumping the light oil to the nozzle 19.2 via the cooler 16.2. After the indirect water cooler 16.2 a certain fraction of light oil is removed as light oil product stream. The remaining fraction is recycled through the nozzle 19.2 to the electrostatic precipitator 10. The offgas leaves the condensation unit through line 14. A pyrolytic water stream of 400 g/h is discharged, which forms a separate phase in the obtained oil fraction and can be separated by known techniques like decanting or likewise.

A light oil product stream (line 17.2) of 500 g/h (86% of total collected oil) and a heavy oil product stream (line 17.1) of 80 g/h (14% of total collected oil) are collected.

Figure 6:
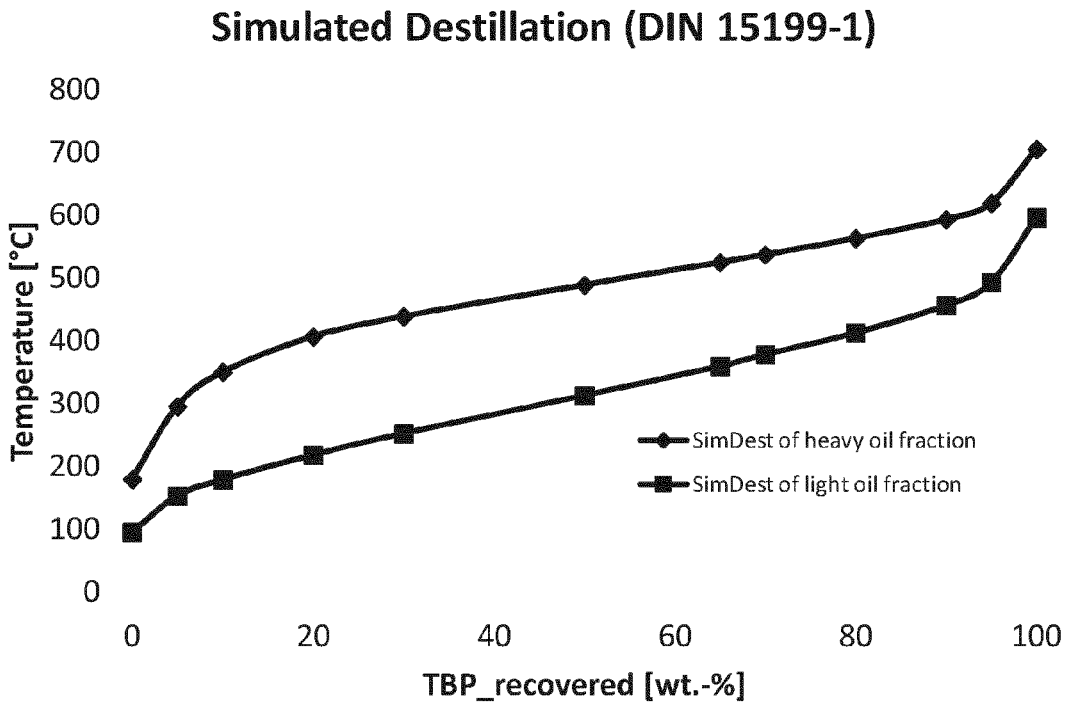
FIG. 6 the result of a simulated distillation based on an apparatus according to FIG. 5.

The results of the simulated distillation of the light and the heavy oil product are displayed in FIG. 6.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

REFERENCE NUMERALS

1 electrostatic precipitator
2 electrode
3 line
4 cooler
5 electrostatic precipitator
5*a* precipitator wall
6 line
7 electrode
8 line
9 electrical trace heater
10 electrostatic precipitator (condensing column)
11 electrode
12 lower part of electrostatic precipitator 10
13 tray
14 line (offgas)
15 pump
16 cooler
17 line
18 recycle line
19 nozzle
20 upper part of electrostatic precipitator 10
21 tray
22 ceiling
23 isolator
ESP electrostatic precipitator
VGM vapor gas mixture

The invention claimed is:

1. A process for winning oil from a vapor gas mixture (VGM) containing a plurality of oil fractions obtained by the pyrolysis of a hydrocarbon containing material, the process comprising:

dedusting the VGM;

cooling the VGM; and fractionating the dedusted and cooled VGM in at least two electrostatic precipitator stages at respective temperatures corresponding to respective boiling points of the oil fractions so as to separate the oil fractions, wherein the VGM is cooled within at least one electrostatic precipitator of the at least two electrostatic precipitator stages.

2. The process according to claim 1, wherein the VGM is obtained by the pyrolysis of oil shale.

3. The process according to claim 1, wherein the VGM comprises 10-90% by weight of $C_{5+}$ hydrocarbons, 4.5-40% by weight of C4-hydrocarbons, 0.01-30% by weight of non condensable fractions and 2-30% by weight of water.

4. The process according to claim 1, wherein the at least two electrostatic precipitator stages include at least one electrostatic precipitator operated at a voltage of 5 to 120 kV.

5. The process according to claim 1, further comprising, for each of the at least two electrostatic precipitator stages, individually controlling a voltage imposed by an electrode of at least one electrostatic precipitator of the at least two electrostatic precipitator stages.

6. The process according to claim 1, wherein the VGM is introduced into each of the at least two electrostatic precipitator stages, at a top or at a bottom thereof.

7. The process according to claim 1, wherein the at least two electrostatic precipitator stages include at least one electrostatic precipitator, the method further comprising withdrawing the oil fractions from the at least one electrostatic precipitator and recycling apart of the oil fractions to the at least one electrostatic precipitator for cooling the VGM.

8. The process according to claim 1, wherein, prior to the fractionating, the VGM is dedusted in an electrostatic precipitator operated at a temperature of 380 to 480° C.

9. An apparatus for winning oil from a vapor gas mixture (VGM) containing a plurality of oil fractions obtained by pyrolysis, the apparatus comprising:

dedusting stage configured to remove dust from the VGM; and a separation stage configured to separate the oil fractions of the VGM based on respective boiling points of the oil fractions, the separation stage including at least two electrostatic precipitator stages each associated with a cooling stage and operated at a temperature adapted to the respective boiling points of the oil fractions to be separated, wherein the apparatus is configured to cool the VGM within at least one electrostatic precipitator of the at least two electrostatic precipitator stages.

10. The apparatus according to claim 9, wherein each of the at least two electrostatic precipitator stages include an electrostatic precipitator associated to a separate cooler.

11. The apparatus according to claim 9, wherein the at least two electrostatic precipitator stages include at least one electrostatic precipitator having an electrode and precipitator wall, wherein a distance between the electrode and the precipitator walls is from 100 to 1000 mm.

12. The apparatus according to claim 9, wherein the at least two electrostatic precipitator stages are disposed in an electrostatic precipitator formed as a condensation column and comprising an electrode for each of the at least two electrostatic precipitator stages.

13. The apparatus according to claim 12, wherein, the electrostatic precipitator comprises a plurality of trays corresponding to a number of the oil fractions to be separated.

14. The apparatus according to claim 9, wherein the at least two electrostatic precipitator stages include at least one electrostatic precipitator having cooling walls.

15. The apparatus according to claim 9, wherein the dedusting stage, disposed upstream of the separating stage, includes an electrostatic precipitator operated at 380 to 480° C. configured to dedust the VGM.

* * * * *